US005964040A

United States Patent [19]

Keene et al.

[11] Patent Number: 5,964,040

[45] Date of Patent: Oct. 12, 1999

[54] ILLUMINATED PROGRESSIVE LENS MARKER

[76] Inventors: Wayne L. Keene, 2390 Crenshaw Blvd., #122, Torrance, Calif. 90501; Jocelyn Towler, 2235 W. 241st St. #5, Lomita, Calif. 90717; Wilson Velasquez, 7616 Acama St., San Diego, Calif. 92126

[21] Appl. No.: 08/869,092

[22] Filed: Jun. 4, 1997

[51] Int. Cl.[6] ..... B43L 11/00; G01B 1/00

[52] U.S. Cl. ..... 33/28; 33/507

[58] Field of Search ..... 33/28, 507, 200

[56] References Cited

U.S. PATENT DOCUMENTS 4,977,675 12/1990 Jewett ..... 33/507

*Primary Examiner*—Bernard Roskoski

*Attorney, Agent, or Firm*—Roger A. Marrs

[57] ABSTRACT

A machine for marking the location for determining the correct prescription of progressive optical lens including a diffused light source, a platform for supporting the progressive lens intended to be marked in the illumination from the light source, an optical reference element having visible indicia thereon for contact against the progressive lens to locate the symbols on the lens that indicate the position of a reference line thereon, and a marker including adjustable marker elements for contact against the lens in alignment with the reference line, to apply temporary opaque symbols on the progressive lens from which the lens prescription can be determined.

10 Claims, 2 Drawing Sheets

34
33
40
41
36
37
35
38
21
18
20
16
17
22
27
24
25
15
23
42
43
12
44
13
14
10
11
32
30
31
20
46
45
32
52
50
53
54
31

FIG. 2
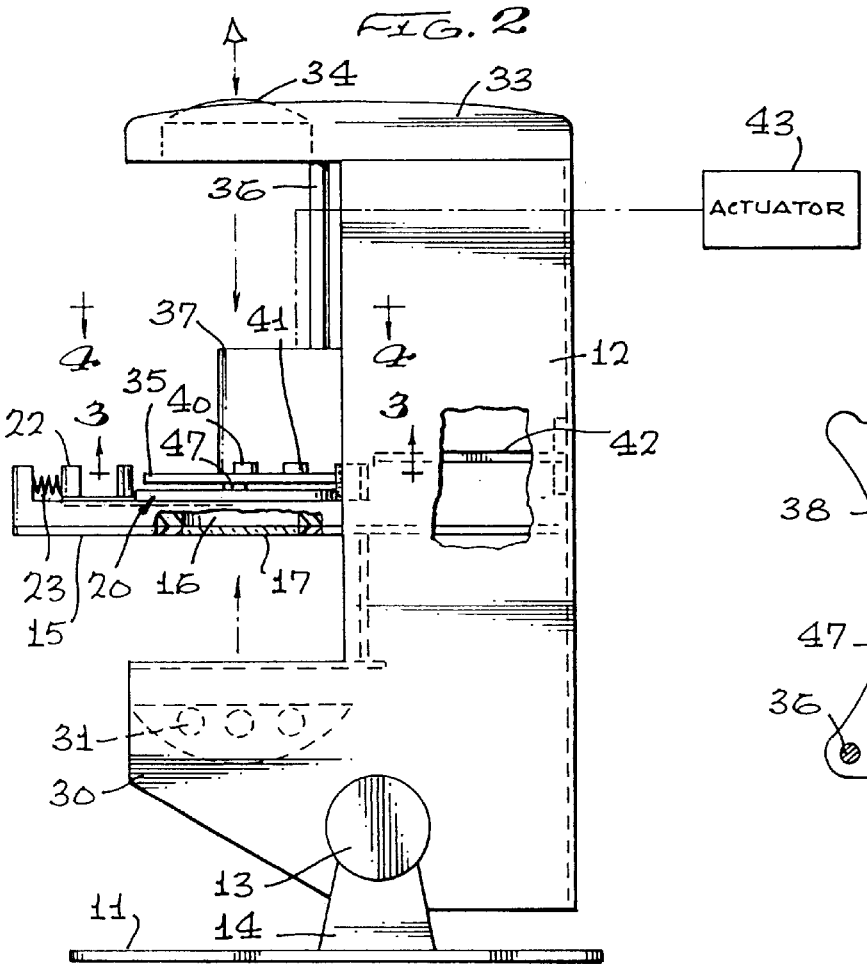
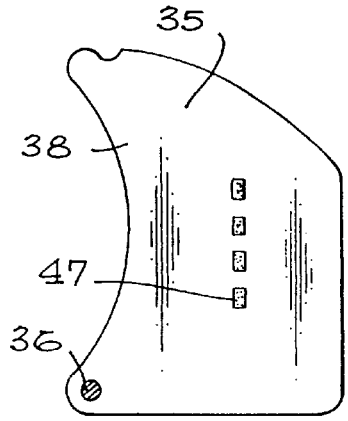
FIG. 3
FIG. 4
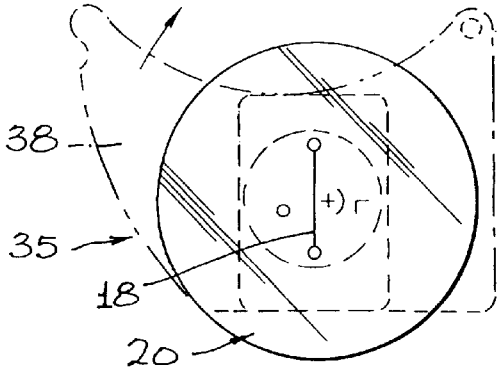
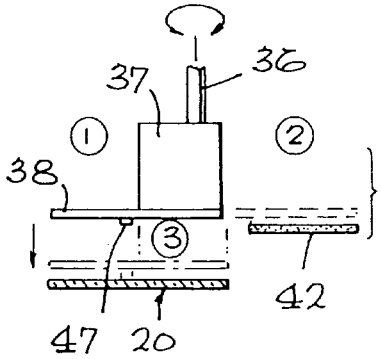
FIG. 5

ILLUMINATED PROGRESSIVE LENS MARKER

BACKGROUND OF THE INVENTION

1. Field of the Invention

The present invention related to the field of optical equipment, and more particularly to a novel marking machine or apparatus for locating precise areas on a progressive optical lens and for marking the optical lens so that correct prescription of the lens can be read with a lensometer.

2. Brief Description of the Prior Art

It is a conventional practice to refer to glass or plastic optical lenses held in a frame as "eyeglasses" and for these eyeglasses to be worn on ones face to correct vision deficiencies or shade the eyes from sunlight or other bright sources. It is not uncommon for the owner of eyeglasses to buy a replacement or "pair" of eyeglasses. Such owner's usually do not remember their eyeglasses prescription and therefore have no way of conveying this information to an optical store or laboratory. Accordingly, each optical store or laboratory must be prepared to determine the prescription from the eyeglasses themselves. Eventually, a machine referred to as a "lensometer" is used in optical stores to determine the prescription. The eyeglasses are placed in the lensometer and the necessary parameters, such as the number of diopters, focal length and power are read from the machine.

While a common form of eyeglasses is the bifocal eyeglass, a newer type of eyeglass is known as the "progressive" bifocal. This type employs two lenses, one for distance, and one for close work. However, there is no visual line of separation between the lenses and they are blended together over a short distance, hence the term "progressive". Because there is no observable line of division between lenses, use of the lensometer is restricted to certain areas of the lenses where the true prescriptions, as opposed to the transitional area prescription, may be viewed and the parameters determined. In order to locate the place on the lens where these prescriptions can be accurately read, manufacturers of progressive lens have created an international standard. This standard is based upon a horizontal "line" that is determinable from observation of two symbols such as small circles or squares, set in spaced-apart arrangement on the lens that are very lightly laser engraved on the lens so that the "reference" line may be hypothetically drawn between them. Each manufacturer of "progressive" lens then sets its area for lensometer viewing in a small circle, usually above and below the "reference" line. Once the correct area for obtaining the prescription of the "progressive" lens has been determined, marking is made to specifically indicate the correct location.

Coventional lens marking apparatuses have no means for magnifying the reference numerals or indicia during the locating procedure and it is difficult to visually observe the procedure since the work is close and no illumination means is provided other than ambient light. Also, conventional means for actually marking the lens is crude, cumbersome and awkward for an optician to use. Furthermore, conventional lens marking machines are generally intended to be placed on a flat surface and do not provide a means for articulation so as to accommodate for sloping surfaces on which the machine may rest.

One attempt to provide a suitable lens marker is described in co-pending and co-owner patent application having Ser. No. 08-550,598.

Therefore, a long standing need has existed to provide a novel lens marking machine for locating the exact spots on "progressive" optical lens so that the resultant marking can indicate the correct prescription of the lens which may be subsequently read with a lensometer. Such a means should include magnification of the referenced information as well as illumination means for assisting the viewer in viewing the entire procedure.

SUMMARY OF THE INVENTION

Accordingly, the above problems and difficulties are avoided by the present invention which provides a novel "progressive" lens marking apparatus which includes a base supporting an upright support member so that it is articulated with respect to the base. The upright support members stanchion or post includes an outwardly projecting platform which releasably supports a lens intended to be marked. A marking element is pivotly carried on a support rod for transverse pivoting movement between an inkpad and a position over the lens intended to be marked and is also arranged for vertical movement between the two aforementioned positions. Control means are carried on the marking means for adjusting reference indicia and magnifying means are carried on the support member stanchion at its upper end for viewing the lens intended to be marked by the user while illumination means are carried on the support member stanchion on the underside of the platform or stage opposite from the magnifying means. Therefore, the viewer is provided magnification of all indicia and the procedure is illuminated by the illumination means. In one form of the invention, the illumination provided is by fluorescent means.

Therefore, it is among the primary objects of the present invention to provide a novel marking apparatus for progressive lenses which will magnify and illuminate lens engraving and which will permit marking of all lenses to manufacturer's specifications. Another object of the present invention is to provide a novel progressive lens marking machine which will verify segment alignment as well as providing convenient and easy measurement by the user.

Yet another object of the present invention is to provide a novel illuminated progressive lens marker which greatly reduces process time and which incorporates useful state-of-the-art technology in combination with additional components such as illumination, magnification and lens handling and marking components.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings, in which:

FIG. 2 is a reduced side elevational view of the marker apparatus shown in FIG. 1;

FIG. 3 is a transverse cross-sectional view of the pivoting marker used in the apparatus of FIGS. 1 and 2 as taken in the direction of arrows 3—3 of FIG. 2;

FIG. 4 is a view similar to the view of FIG. 3 of the lens intended to be marked and the relationship of the marker as taken in the direction of arrows 4—4 of FIG. 2;

FIG. 5 is a diagrammatic view of the marking procedure used in operating the marking apparatus shown in FIGS. 1 and 2.

DESCRIPTION OF PREFERRED EMBODIMENT

Figures 1, 6:
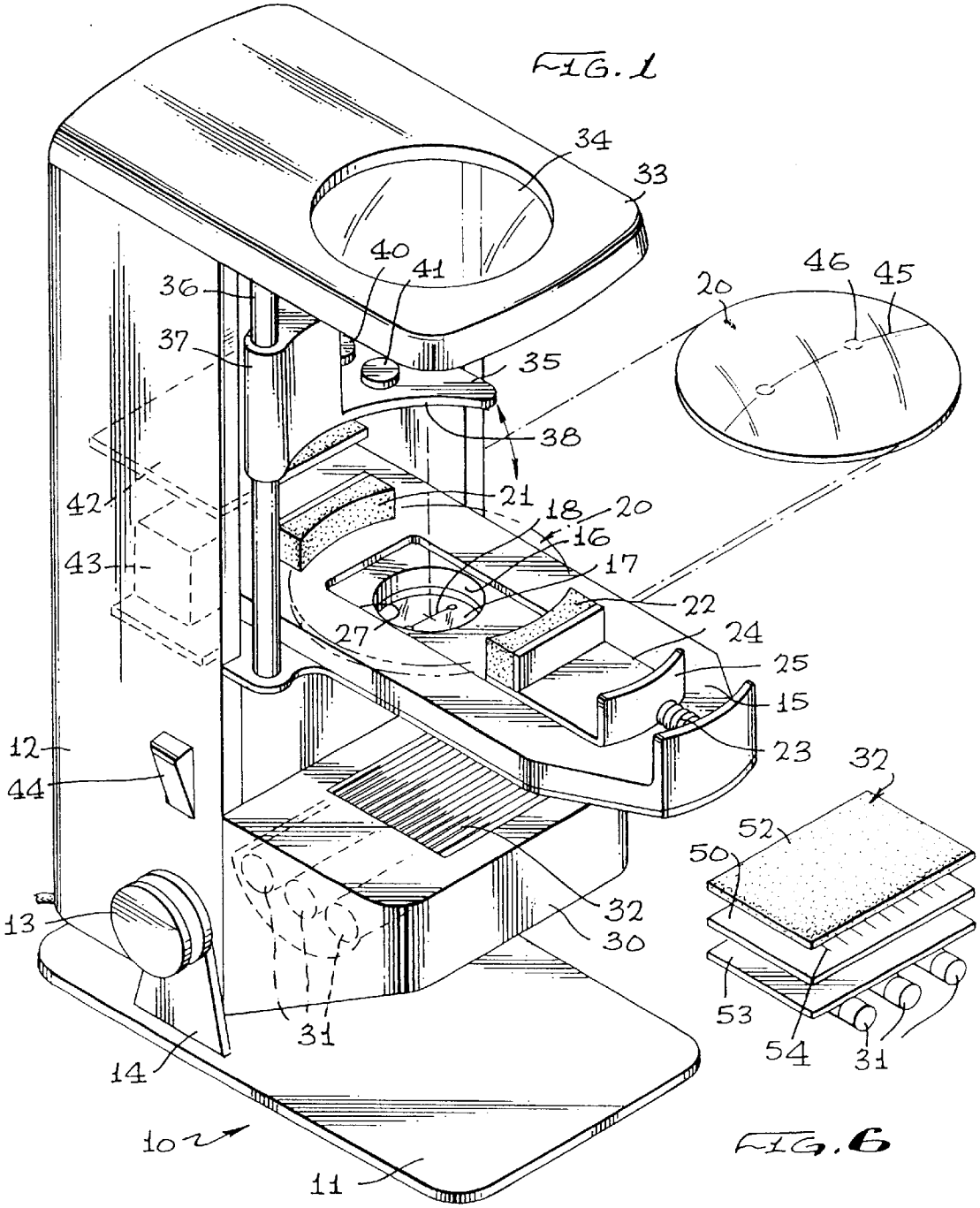
FIG. 1 is a front perspective view of the novel illuminated progressive marker incorporating the present invention.
FIG. 6 is an exploded perspective view of the grating window employed in the illumination means shown in FIG. 1.

Referring to FIG. 1, the novel illuminated progressive lens marking device 10 of the present invention is illustrated in the general direction of the arrow which includes a base 11 that may be placed on a table surface or the like and which further includes an upright support 12 which is pivotly carried on the base 11 by means of a manually operated pivot mechanism 13 and a supporting yoke 14. Midway between the opposite end of support member 12, there is provided an outwardly projected and cantilevered platform 15 which includes a central opening 16 that is employed to reveal a transparent reference plate 17. The plate includes indicia represented by numeral 18 which may include a reference line and circles or squares that are used in marking the horizontal line on a lens 20. The lens 20 is placed over the central opening 16 on the upper surface of the platform 15 between a cushioned clamp represented by cushion 21 and cushion 22 arranged on opposite sides of the lens 20. A spring 23 forcibly urges a sliding section 24 to clamp lens 20 between the cushions 21 and 22. The spring 23 is of an expandable type which bears against a plate 25 on the sliding section 24 and a stationary inplate 26 carried on the end of platform 15. It can be seen that the sliding section 24 moves in a track broadly identified by numeral 27 which is in communication with the opening 16.

The marker device 10 further includes an illumination means carried within an enclosure 30 which is located on the underside of the platform 15 between the platform and the base 11. The relationship is spaced apart and the illumination means includes at least a pair of fluorescent tubes or bulbs with one such bulb or tube identified by numeral 31. The illumination means further includes a special grid 32 of light transmitting or passing material having parallel scribed lines. The markings molded into progressive lenses through engravings in the molding tool are most easily viewed as shadow transition lines played over the surface of the lens and into the grooves which form the markings. The discontinuity formed by the shadows trace across the markings in the lens and provide sufficient information for the viewer's eye to "fill in" the remaining information. A major feature of the present invention is to employ a diffused light source including the fluorescent lights 31, that shine through the grated translucent or transparent window 32. The grating window provides the required shadow transition lines. Several advantageous results are obtained through the inventive system by spacing the lens, the eye and the light source/grating or lined system in such a relationship as to achieve the following:

1. Illuminate the markings in the lens,
2. Put the lens markings in sharp focus,
3. Prints markings on lenses, and
4. Provide approximately 4 to 6 grating lines going through a given marking.

At the upper end of the support member/stanchion 12, there is provided a overhanging member 33 on which a magnifying lens 34 is carried. The magnifying lens 34 is in coaxial relationship, spaced apart, with respect to the opening 16 and consequently the lens 20 when it is positioned on platform 15. Therefore, a viewer's eye observing through the magnifying glass can readily locate and find the reference indicia 18.

The marking device 10 also includes a marking means 35 which may take the form of a marking member 35 that is slightably and pivotally carried on a support rod 36 which extends between the overhanging member 33 and the platform 15. The marking means 35 includes a sleeve housing 37 which is carried on the rod 36 and further includes an outwardly projecting section 38 which carries marking adjustment dials 40 and 41. The user may readily rotate or turn these dials to position the markers on the member 38 so that alignment with the reference indicia 18 can be coordinated. The marking means further includes an inked pad 42 which has an exposed ink surface against which the marking projections carried by the marking number 38 can receive ink preparatory to marking the lens 20. Also, it is to be understood that the marking means 35 can be operated manually by grasping of the member 38 with the fingers of the operator or user or if desired, a marking means may be activated by the use of a motor 43. A suitable on/off switch 44 may be employed for operating the motor means 43 and/or separately for operating the illumination means 30.

The lens intended to be marked includes a surface facing the underside of the marking plate 38 and the marks placed on the surface is indicated by a horizontal line 45 with respect to alignment circles 46. The alignment circles may be placed in a stationary position or any useful orientation such as above and below the marking line or the same plane depending on the marking procedure.

Referring now in detail to FIG. 2 and FIG. 3, it can be seen that the marking means 35 includes an undersurface on member 38 which mounts downwardly depending marking elements such as element 47. When the member 38 is in the position as shown in FIG. 1, the marking elements contact the inkpad 42 and when the member 38 is moved into the position shown in FIG. 2, the member has been rotated over the lens 20 and permitted to slide down the post 36 so that the marking elements 47 come into contact with the upper surface of the lens 20 intended to be marked. Once the marking has been achieved, the member 38 can be raised and then rotated within the support member 12 to a position on the inkpad 42.

Referring now in detail to FIG. 4, a diagrammatic illustration is presented which shows the alignment of the reference indicia with respect to the lens 20 during a marking operation. The marking plate 38 of the marking means 35 is illustrated in broken lines positioned preparatory to marking upon the alignment of the lens 20 with the marking reference indicia 18.

FIG. 5 further illustrates a diagrammatic view wherein the plate or member 38 of the marking means is moved from the plate 42 into the marking position shown in solid lines which is then followed by lowering the marking member 38 to the broken line position where marks are made on the surface of the lens 20 by the marking elements 47.

Therefore, it can be seen that the inventive concept provides for a marking device to be employed by professional users to mark or remark progressive bifocals to accurately neutralize prescriptions from glasses. A marking device 10 will directly influence the accuracy and efficiency in reading prescriptions from progressive bifocals. The advent of progressive bifocals resulted in a problem for opticians regarding the way in which glasses are fabricated and are read. As the prescription of each lens changes progressively from top-to-bottom section of the lens, the optical professionals may be uncertain where to place the lens on the epicure of a lensometer to accurately arrive at the correct prescription. The inventive marking device 10 overcomes this difficulty in that the device is capable of locating laser markings embedded within the progressive lenses using a unique arrangement of the fluorescent light source, diffusing or transparent griding, the magnifying means and the overall placement and alignments of the lens 20 with respect to the magnifying means, illumination means, and the marking means. Once the lens 20 has been aligned or centered, the lens is stamped and marked according to the manufacturers specifications using the adjustable, progressive marker. Next, the lens or glasses can be removed and placed on any standard lensometer or electronic analyzer and the prescription can be read in the traditional manner using the markings as a guide to indicate the proper positioning of the lenses.

FIG. 6 illustrates the grating window 32 employed in conjunction with the light source 31 to provide a diffused light source and to provide the required shadow transition lines so that the integral molded or engraved reference markings on the optical progressive lens 20 can be seen. The window comprises a mid-sheet or plate 50 having a plurality of lines arranged in fixed parallel spaced apart relationship. Sheet 50 is sandwiched between outer sheets or plates 52 and 53 with exposed outer sheet 52 being frosted to provide light diffusion. The sheets may be secured together by heat sealing techniques or other suitable means.

The parallel lines, such as line 54, cast a plurality of transition shadow lines over the mold markings on the surface of the optical progresive lens and into the grooves which form the markings. The discontinuity formed by the shadows tracing across the markings on the lens provide sufficient information for the professional user's eye to "fill in" any remaining information. The sandwiched sheets are either translucent or transparent or a combination thereof. For example, sheets 50 and 53 may be clear while sheet 52 is frosted. The lines may run either from side-to-side on sheet 50 or from end-to-end depending on best casting of shadow lines.

While particular embodiments of the present invention have been shown and described, it will be obvious to those skilled in the art that changes and modifications may be made without departing from this invention in its broader aspects and, therefore, the aim in the appended claims is to cover all such changes and modifications that fall within the true spirit and scope of this invention.

What is claimed is:

1. A machine for marking the location for determining the correct prescription of progressive optical lens comprising:

a support member;

a magnifying means carried on said support member;

an illumination means carried on said support member in spaced-apart relationship;

a platform cantilevered outwardly from said support member and disposed between said magnifying means and said illumination means;

an optical reference element having visible indicia thereon for locating symbols on the lens that indicate the position of the reference line thereon; and marker means operably carried on said support member having marker elements for engaging against the lens in alignment with the reference line so as to apply marks on the progressive optical lens from which the lens prescription can be determined.

2. The machine as defined in claim 1 wherein:

said optical reference element is secured to said platform in optical alignment between said magnifying means and said illumination means.

3. The machine as defined in claim 2 wherein:

said illumination means includes a diffused light source and a grating window situated between said diffused light source and said optical reference element.

4. The machine as defined in claim 3 wherein:

said grating window provides required shadow transition lines associated with said reference indicia.

5. The machine as defined in claim 4 wherein:

said marker means includes a movable marker having downwardly depending marking elements and having a first position in storage within said support member and a second position over the progressive optical lens intended to be marked carried on said platform over said optical reference element.

6. The machine as defined in claim 5 including:

clamping means carried on said platform for releasably holding the progressive lens in aligned registry with said optical reference element.

7. The machine as defined in claim 6 including:

an ink pad secured to said support member for transferring ink to said marker elements when said marker means is in said first position.

8. The machine as defined in claim 7 including:

motor means operably coupled to said marker means for positioning said marker means between said first and said second position.

9. The machine as defined in claim 3 wherein:

said illumination means is a set of fluorescent tubes detachably mounted on said support member immediately adjacent to said grating window.

10. A machine for marking the locations for determining the correct prescription of a progressive optical lens comprising:

a support member a platform movably carried on said support member for vertical adjustment;

an optical reference element secured to said platform and having visible reference indicia thereon adapted to be referenced with the progressive optical lens;

a marker means movably carried on said support member for positioning against the progressive optical lens to locate said reference indicia thereon and that marks the position of said reference indicia;

magnification means carried on said support member;

illumination means carried on said support member;

said platform extending outwardly from said support member in a cantilevered manner with the progressive optical lens in optical alignment therebetween;

said illuminating means being a diffused light source;

the progressive optical lens having molded markings thereon responsive to said diffused light source to be viewed as shadow transition lines over the progressive optical lens provide information sufficient to mark the progressive optical lens therewith;

a grating window disposed between said diffused light source and said platform whereby said grating window provides the required shadow transition lines;

spacing between said light source and said grating window with respect to the viewer's eye and the progressive optical lens is in such a spaced-apart relationship as to achieve:

a. illumination of said molded lens markings b. placing said lens markings in sharp focus c. placing said diffusion grating window just out of focus; and d. providing grating lines passing through a given one of said molded lens markings.

* * * * *